US011103882B2

(12) United States Patent
Mankosa et al.

(10) Patent No.: US 11,103,882 B2
(45) Date of Patent: Aug. 31, 2021

(54) AIR-ASSISTED SEPARATION SYSTEM

(71) Applicant: Eriez Manufacturing Co., Erie, PA (US)

(72) Inventors: Michael J. Mankosa, Erie, PA (US); Jaisen N. Kohmuench, Erie, PA (US); Eric S. Yan, Erie, PA (US)

(73) Assignee: Eriez Manufacturing Co., Erie, PA (US)

( * ) Notice: Subject to any disclaimer, the term of this patent is extended or adjusted under 35 U.S.C. 154(b) by 1298 days.

(21) Appl. No.: 15/007,802

(22) Filed: Jan. 27, 2016

(65) Prior Publication Data

US 2016/0136657 A1 May 19, 2016

Related U.S. Application Data

(63) Continuation of application No. 14/056,677, filed on Oct. 17, 2013, now Pat. No. 9,278,360.

(51) Int. Cl.

| | |
|---|---|
| ***B03D 1/14*** | (2006.01) |
| ***B03D 1/24*** | (2006.01) |
| ***B03D 1/02*** | (2006.01) |
| ***B03B 5/62*** | (2006.01) |
| ***B03B 5/66*** | (2006.01) |

(52) U.S. Cl.

CPC ..... *B03D 1/247* (2013.01); *B03B 5/623* (2013.01); *B03B 5/66* (2013.01); *B03D 1/02* (2013.01); *B03D 1/028* (2013.01); *B03D 1/14* (2013.01); *B03D 1/1443* (2013.01); *B03D 1/245* (2013.01)

(58) Field of Classification Search

CPC ..... B03B 5/623; B03B 5/66
USPC ..... 209/168–170
See application file for complete search history.

(56) References Cited

U.S. PATENT DOCUMENTS 3,371,779 A * 3/1968 Hollingsworth ..... B01F 5/0212 209/166
3,421,621 A * 1/1969 Hollingsworth ..... B03D 1/02 209/166
5,456,362 A * 10/1995 Laskowski ..... B03D 1/01 209/164
5,759,408 A * 6/1998 Jarvenpaa ..... B01F 5/0401 210/221.2
6,425,485 B1 * 7/2002 Mankosa ..... B03B 5/623 209/158

* cited by examiner

*Primary Examiner* — Thomas M Lithgow
(74) *Attorney, Agent, or Firm* — Jonathan M. D'Silva; MMI Intellectual Property

(57) ABSTRACT

A separation system is presented that partitions a slurry containing a plurality of particles that are influenced by a fluidization flow (which comprises teeter water and gas bubbles) and a fluidized bed. The separation system comprises a separation tank, a slurry feed distributor, a fluidization flow manifold and a gas introduction system. All of these components are arranged to create the fluidized bed in the separation tank by introducing the slurry through the slurry feed distributor and allowing the slurry to interact with the fluidization flow that enters the separation tank from the fluidization flow manifold. The gas introduction system is configured to optimize the gas bubble size distribution in the fluidization flow. The gas introduction system comprises a gas introduction conduit and a bypass conduit. The gas introduction system can be adjusted by modulating the flow of teeter water through the gas introduction conduit.

22 Claims, 4 Drawing Sheets

AIR-ASSISTED SEPARATION SYSTEM

This application is a continuation of U.S. application Ser. No. 14/056,677, filed on Oct. 17, 2013, now allowed, incorporated herein by reference.

BACKGROUND

Fluidized-bed or teeter-bed separation systems are used for classification and density separation within the mining industry. The metallurgical performance and high capacity of these separation systems make them ideal for feed preparation prior to flotation circuits. It has been found that when this type of separation system implements a fluidization flow with the addition of air bubbles, performance can be improved beyond that achieved by systems using only water. This variety of separator is called an air-assisted separation system. These devices are typically controlled using two basic operating parameters: fluidization flow rate and fluidized bed level. What is presented are improvements to an air-assisted separation system, incorporating various novel features, that further enhance the separation process.

SUMMARY

What is presented is a separation system for partitioning a plurality of particles contained in a slurry. The particles are influenced by a fluidization flow, which comprises teeter water, gas bubbles, and a fluidized bed. The separation system comprises a separation tank, a slurry feed distributor, a fluidization flow manifold, a gas introduction system, and an underflow conduit all arranged to create the fluidized bed in the separation tank by introducing the slurry through the slurry feed distributor and allowing the slurry to interact with the fluidization flow from the fluidization flow manifold. The separation tank has a launder for capturing particles carried to the top of the separation tank. The gas introduction system is configured to optimize the gas bubble size distribution in the fluidization flow. The gas introduction system comprises a gas introduction conduit and a bypass conduit for a flow of teeter water to bypass the gas introduction conduit. The gas introduction system can be adjusted to optimize the gas bubble size distribution by modulating the flow of teeter water through the gas introduction conduit. The gas introduction conduit and the bypass conduit converge to create the fluidization flow. The volume of fluidization flow is controlled by modulating the flow through said gas introduction system.

In some embodiments of the separation system, a pressure reading apparatus is arranged and configured to measure the density of the fluidized bed. In some embodiments the pressure reading apparatus comprises two pressure sensors to measure the density of the fluidized bed, or a differential pressure transmitter configured to measure the density of the fluidized bed. In some embodiments a density indicating controller is used to control the gas introduction system and the underflow conduit and to adjust the density and level of the fluidized bed based on calculations performed by the density indicating controller based on signals from the pressure reading apparatus.

Some embodiments of the separation system comprise a slurry aeration system for aerating the feed slurry. Some of these embodiments comprise a sparging apparatus for aerating the fluidization water. Other embodiments of the separation system further comprise a chemical collector or a surfactant introduced into the fluidization flow to condition the particles in the slurry or to facilitate aeration of the fluidization flow.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
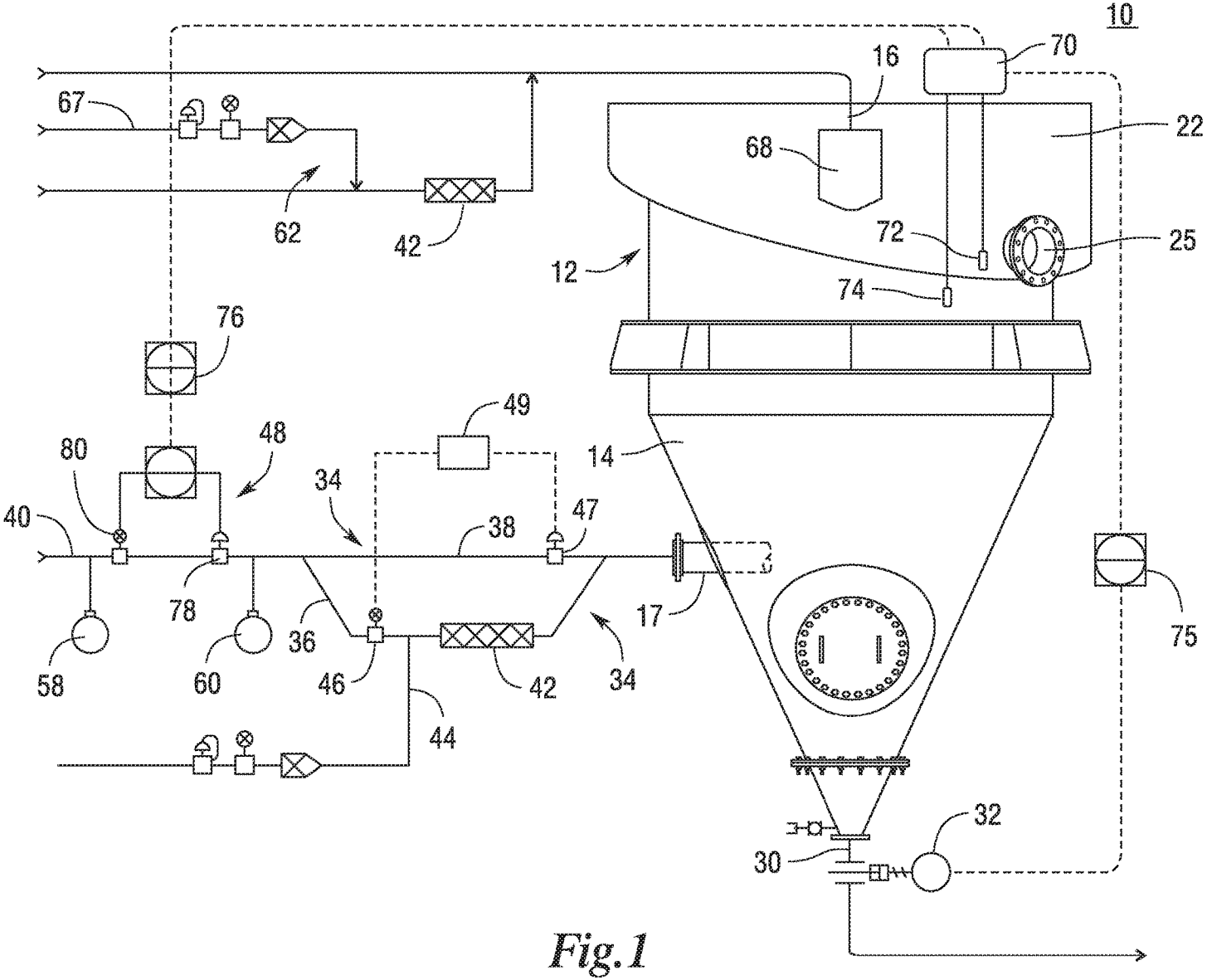
FIG. 1 shows a schematic view of the separation system.

Referring to the drawings, some of the reference numerals are used to designate the same or corresponding parts through several of the embodiments and figures shown and described. Variations of corresponding parts in form or function that are depicted in the figures are described. It will be understood that variations in the embodiments can generally be interchanged without deviating from the invention.

Figure 2:
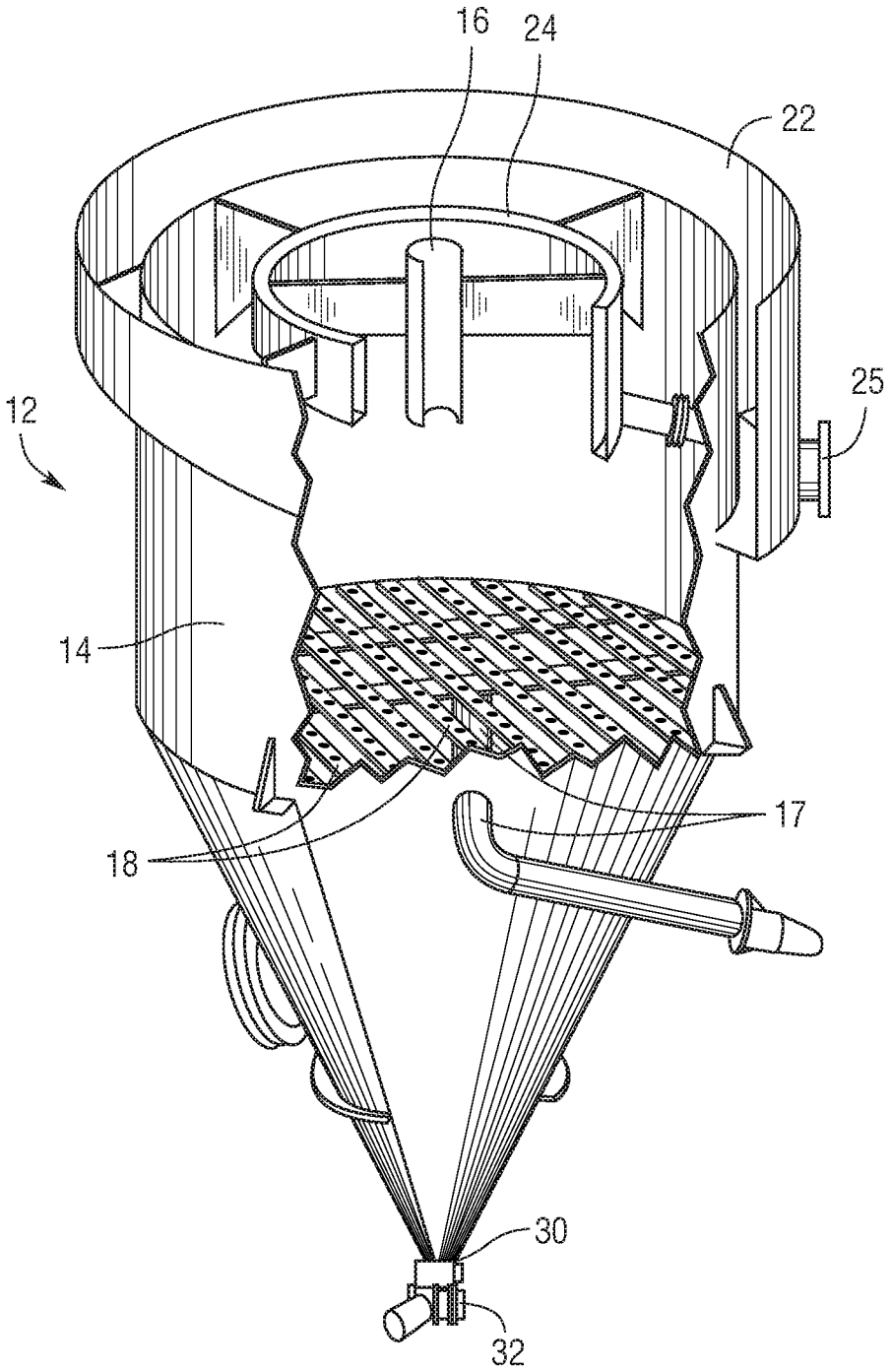
FIG. 2 is a perspective view of a fluidized bed separation cell.
Figure 3:
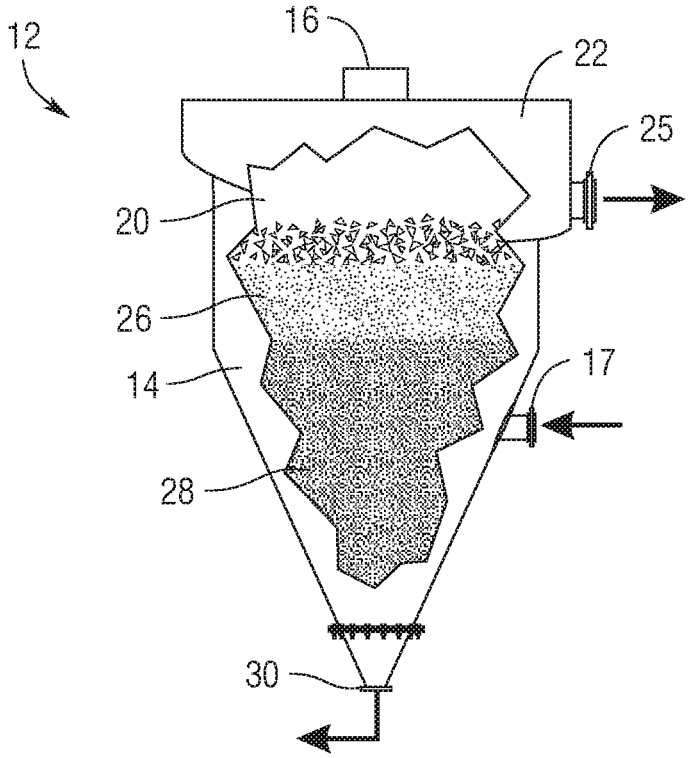
FIG. 3 is a cross-section of a separation tank showing the components of a typical fluidized bed.

Separation systems implementing fluidized beds (also called a teeter bed or a teeter water bed or a fluidized teeter bed) are commonly used in the minerals industry to partition a plurality of particulate mineral species contained in a liquid suspension or slurry. These slurries consist of a mixture of valuable and less valuable mineral species. Separation systems that implement an aerated fluidization flow (teeter water with gas introduced to form gas bubbles) and a fluidized bed are called air-assisted separation systems. An example of an air-assisted separation system as described herein is the HYDROFLOAT™, manufactured by Eriez Manufacturing Company of Erie, Pa. As shown in FIGS. 1 through 3, the air-assisted separation system 10 comprises a fluidized bed separation cell 12 with an associated gas introduction system 38, slurry aeration system 62, and pressure reading apparatus 70, each discussed in more detail below. As best understood by comparing FIGS. 1 and 2, slurry is fed into a separation tank 14 through a slurry feed distributor 16, generally located in the upper third of the separation tank 14. The particulate mineral matter in the slurry moves downwards countercurrent to an upward flow of teeter water. The teeter water is fed into the separation tank 14 through a fluidization flow manifold 18 generally located around the center of the separation tank 14 and connected to an inflow conduit 17.

Comparing FIGS. 2 and 3, as slurry is introduced into the upper section of the separation tank 14 through the slurry feed distributor 16, the upward flow of teeter water and gas bubbles collide with the downward flowing slurry, causing the particles in the slurry to separate as a result of some of the particles in the slurry selectively attach to the gas bubbles. The particles that are fine/light are hydraulically carried upward by the flow of teeter water and those particles attached to the gas bubbles float to the top, staying within an overflow layer 20 to eventually be carried over the top of the separation tank 14. After being carried over the top of the separation tank 14, these particles flow into either an external overflow launder 22 or an internal overflow launder 24 and are carried out of the system by an overflow conduit 25 that drains both overflow launders 22 and 24.

The particles that are more coarse/dense, and those that did not attach to the gas bubbles that have sufficient mass to settle against the upward flow of teeter water, fall downwardly through the separation tank 14 and form a fluidized bed 26 of suspended particles. The fluidized bed 26 acts as a dense medium zone within the separation tank 14. Within the fluidized bed 26, small interstices create high interstitial liquid velocities that resist the penetration of the particles that could settle against the upward flow of teeter water, but that are too fine/light to penetrate the already formed fluidized bed 26. As a result, these particles will initially fall downward until they contact the fluidized bed 26 and are forced back upwardly to accumulate in the overflow layer 20. These particles are eventually carried to the top of the separation tank 14 and end up in one of the overflow launders 22 or 24.

The particles that are too coarse/dense to stay above the fluidized bed 26 and those that do not attach to a gas bubble will eventually pass down through the fluidized bed 26 and into an underflow layer 28. Once in the underflow layer 28, these particles are ultimately discharged from the underflow layer 28 through an underflow conduit 30. An underflow valve 32 regulates the amount of coarse/dense and unattached particles discharged from the separation tank 14. The type of underflow valve 32 is dependent on the application and can vary from a rubber pinch valve to an eccentric plug valve, but it should be understood that any under flow valve 32 that can adequately regulate the discharge of coarse/dense particles may work.

Hindered-bed separators segregate the particles that are fine/light from those that are course/dense based on their size and specific gravity. The separation effect is governed by hindered-settling principles, which has been described by numerous equations including the following:

$$U_t = \frac{gd^2(\phi_{max} - \phi)^{\beta}(\rho_s - \rho_f)}{18\eta(1 + 0.15Re^{0.687})}$$

where $U_t$ is the hindered-settling velocity of a particle (m/sec), g is the acceleration due to gravity (9.8 m/sec$^2$), d is the particle size (m), $\rho_s$ is the density of the solid particles (kg/m$^3$), $\rho_f$ is the density of the fluidizing medium (kg/m$^3$), $\eta$ is the apparent viscosity of the fluid (kg·m$^{-1}$·s$^{-1}$), $\varphi$ is the volumetric concentration of solids, $\varphi_{max}$ is the maximum concentration of solids obtainable for a given material, and $\beta$ is a function of Reynolds number (Re). By inspection of this equation one having ordinary skill in the art can determine that the size and density of a particle greatly influences how that particle will settle within a hindered settling regime.

One having ordinary skill in the art can also see that aerating the teeter water, by introducing gas (i.e., air) into the flow of the teeter water to create gas bubbles, will affect the settling characteristics of the particles that attach to these gas bubbles. The fluidization flow of the air-assisted separation system is aerated by introducing gas into the flow of teeter water prior to entering the separation tank 12. Therefore, for known slurry compositions, the fluidization flow can be modulated to optimize gas bubble interactions with target particles and carry these target particles to the top of the separation tank 12 for removal.

As shown in FIG. 1, a gas introduction system 34 is used to optimize the gas bubble introduction to the fluidization flow. The gas introduction system 34 comprises two conduits arranged in parallel, a gas introduction conduit 36 and a bypass conduit 38. Both conduits are located downstream from a teeter water supply line 40, which provides the supply of teeter water to the gas introduction system 34, and upstream from the inflow conduit 17 and fluidization flow manifold 18. When the flow of teeter water enters the gas introduction system 34, it splits apart so that a first portion of the flow of teeter water flows through the gas introduction conduit 36 and a second portion of teeter water flows through the bypass conduit 38.

The first portion of the flow of teeter water is aerated in the gas introduction conduit 36. A gas introduction point 44 introduces gas into the flow of teeter water to generate bubbles as the flow of teeter water passes through the gas introduction conduit 36. A sparging apparatus 42 sparges, or breaks up, the generated gas bubbles into smaller gas bubbles. Any type of sparging apparatus that can sparge the bubbles sufficiently may be used, such as, but not limited to, an inline static mixer or high shear sparging system. Generally, the sparging effect of the sparging apparatus 42 varies with the flow rate of teeter water through it. The gas introduction conduit 36 also comprises a flow meter 46 to monitor the rate of flow of teeter water through the gas introduction conduit 36. Typically, this flow meter 46 is located upstream of the gas introduction point 44 to reduce the interference of gas bubbles on the operation of the flow meter 46.

The gas introduction system 34 may combine other types of systems to introduce gas and sparge bubbles than have been shown. In FIG. 1, the gas introduction point 44 is shown to provide pressurized gas to the system. It will be understood that systems that do not need condensed gas to operate may be used instead, such as aspirators that utilize the Venturi effect to draw gas into the flow of teeter water. The bypass conduit 38 allows the second portion of the flow of teeter water to bypass the gas introduction conduit 36, without interfering with the efficient operation of the sparging apparatus 42. The bypass conduit 38 comprises an automatic valve 47, which controls the volume of flow passing through the bypass conduit 38. At the end of the gas introduction system 38 when both the first and second portions of the flow of teeter water converge, the portions combine to create the fluidization flow that enters into the fluidized bed separation cell 12.

When the separation system 10 is in use, the flow meter 46 communicates with a computing mechanism 49, which communicates with and adjusts the automatic valve 47 to throttle the flow of teeter water passing through the bypass conduit 38. This approach maintains a constant flow of teeter water through the gas introduction conduit 36. The teeter water supply line 40 also incorporates a control system 48 which consists of a flow measurement device 78, a flow control valve 80 and a density indicating controller 76, discussed below. The control system 48 modulates the volume of flow of teeter water before entering the gas introduction system 34, which will subsequently optimize the volume of fluidization flow entering into the fluidized bed separation cell 12.

In certain applications, air-assisted separation systems use reagents, such as chemical collectors, to condition particles to improve attachment of target particles to the gas bubbles. Surfactants are also used to facilitate the general creation of gas bubbles. To introduce these reagents, prior art separation systems (not shown) typically incorporate a plurality of stirred-tank conditioners (not shown). The stirred-tank conditioners, however, consume a great deal of energy and occupy significant floor space. As such, there is an incentive within the field to achieve the goal of introducing reagents into separation systems while consuming less energy and space than would be needed to incorporate a plurality of stirred-tank conditioners.

Referring back to FIG. 1, it has been found that reagents can be introduced into the separation system 10 simply by being injected into the teeter water supply line 40 using a collector pump 58 or a surfactant pump 60. As the reagent is introduced into the teeter water supply line 40, it travels with the teeter water to the gas introduction system 34. Injecting the reagents into the gas introduction system 34 causes them to directly and completely mix into the fluidization flow prior to entering the separation tank 14. It has also been found that mixing the reagents and fluidization flow through the gas introduction system 34 in this manner causes a more evenly distributed and intimate mixture than one created through the use of a stir tank.

It has also been found that pre-aeration of the slurry within the slurry feed distributor 68 allows for contacting of the gas bubbles and particles entering the separation tank 12. To accomplish pre-aeration, a slurry aeration system 62 is incorporated into the feed introduction system 16. The slurry aeration system 62 introduces aerated water into the slurry while still traveling through the slurry feed piping 16 or directly into the slurry feed distributor 68. The slurry aeration system 62 comprises two lines, a water introduction line 64 and an air introduction line 67. The water and air pass through a sparging apparatus 42 and is subsequently discharged into the slurry feed piping 16 or the slurry feed distributor 68. The addition of air into the feed slurry enhances the flotation kinetics by reducing the contacting time required in the separation tank 12.

Figure 4A:
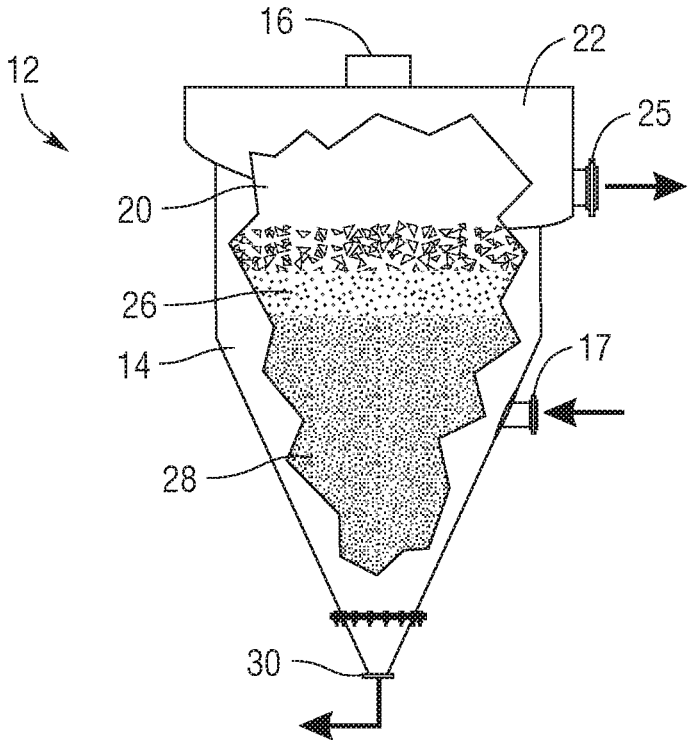
FIG. 4A is a cross-section of a separation tank showing the components of a less-dense fluidization bed.
Figure 4B:
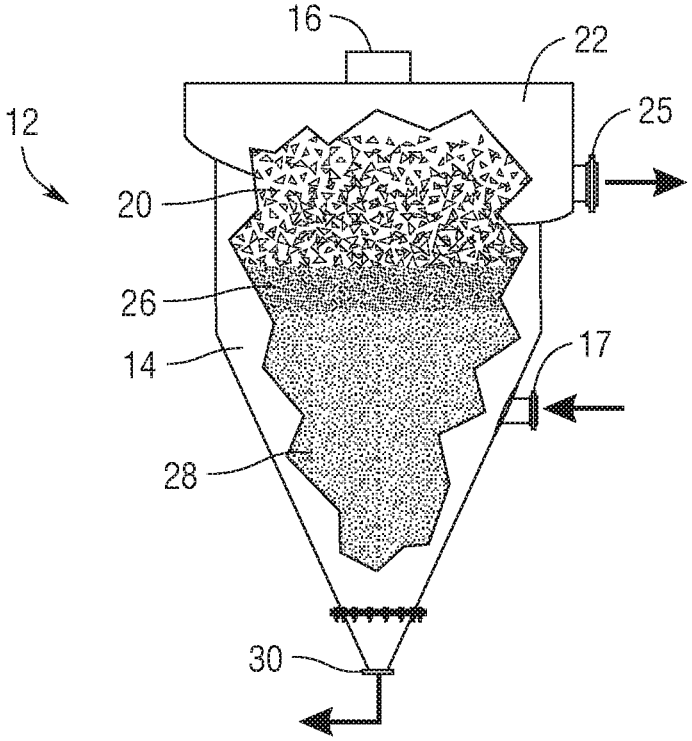
FIG. 4B is a cross-section of a separation tank showing the components of a more-dense fluidization bed.

It has also been found that if the density of the fluidized bed 26 is manipulated, it is possible to influence the type of the particles that flow through the fluidized bed 26. As shown in FIGS. 4A and 4B, when the fluidized bed 26 becomes denser, particles that are coarser/denser can be held within the fluidized bed 26 without falling downward into the underflow layer 28. The opposite effect occurs when the fluidized bed 26 is more dilute and less dense. As the fluidized bed 26 becomes less dense, particles that are fine/light will fall downward through the fluidized bed 26 and into the underflow layer 28. Given that the separation system can make separations based on the size and/or density of the particles within the slurry, it is beneficial to adjust the density of the fluidized bed 26 so as to control the operation of the fluidized bed separation cell 12.

Referring back to FIG. 1, to adjust the fluidized bed 26, a pressure reading apparatus 70 is installed within the fluidized bed separation cell 12 to gauge the pressure within the fluidized bed 26 and relay that information to a computing mechanism (not shown), which calculates the density of the fluidized bed 26. The computing mechanism is typically a programmable logic controller, but any apparatus able to calculate the density of the fluidized bed 26 may work.

At least two pressure transducers are placed within the separation tank 14, an upper pressure transducer 72 and a lower pressure transducer 74. The pressure transducers 72 and 74 are typically individual pressure sensors that have internal strain gauges used to measure the pressure created by the mixture of fluid and slurry surrounding the pressure sensors within the separation tank 14. Both the upper pressure transducer 72 and a lower pressure transducer 74 are configured to read the density of the fluidized bed 26 immediately surrounding their position within the separation tank 14. It should be noted that even though pressures transducers with internal strain gauges are commonly used, one of ordinary skill in the art will see that any device able to read and convey the pressure of the surrounding pressure of the fluidized bed may work, such as, but not limited to, a differential pressure transmitter configured to measure the discrete density of the fluidized bed or a single differential pressure transmitter. The readings from the transducers 72 and 74 is compiled and sent by the pressure reading apparatus 70 to the computing mechanism to be calculated.

The density of the fluidized bed 26, $\rho_b$, is calculated by the computing mechanism using the following equation:

$$\rho_b = \frac{\Delta P \times A}{V_z} = \frac{\Delta P}{H}$$

where ΔP is the differential pressure reading calculated from the upper pressure transducer 72 and lower pressure transducer 74, A is the cross-sectional area of the separator, $V_z$ is the volume of the zone between the two transducers 72 and 74, and H is the elevation difference between these transducers 72 and 74.

The upper pressure transducer 72 and lower pressure transducer 74 are each installed at different elevations but in close proximity to one another. The typical elevation difference between the upper pressure transducer 72 and lower pressure transducer 74 is 12 inches (305 mm) to minimize any signal disturbances caused by turbulence of the fluidized bed 16, but one of ordinary skill in the art will see that any distance between the transducers may work.

As the volume of fluidization flow being introduced into the separation tank 14 increases, it dilutes the fluidized bed 26 and causes the bed to expand, resulting in a lower density reading from the pressure transducers 72 and 74. In contrast, as the volume of fluidization flow introduced into the separation tank 14 decreases, the fluidized bed 26 will contract and becomes denser, resulting in a higher density reading from the pressure transducers 72 and 74. To control the volume of fluidization flow entering and leaving the separation tank 14, a density indicating controller 76 monitors the readings from the two pressure transducers 72 and 74 and subsequently adjusts the flow rate of teeter water to the gas introduction system 34. A density indicating controller 76 can also control the level of the fluidized bed 26 by monitoring the reading from only one of the two pressure transducers 72 and 74, typically the lower pressure transducer 74, and subsequently causing fine tuned adjustments based on that single reading.

A second density indicating controller 75 is also used to control the level of the fluidized bed 26 by monitoring the reading from only one of the two pressure transducers 72 and 74, typically the lower pressure transducer 74, and subsequently adjusting the discharge rate of material exiting the separation tank 14 via the underflow control valve 32.

When incorporating the pressure transducers 72 and 74, adjusting the volume of fluidization flow entering and leaving the separation tank 14 should typically be set to occur very slowly and in small increments, otherwise the changes in the volume of fluidization flow can cause large fluctuations in the two pressure transducers 72 and 74 that will create inaccuracies within the density calculations. It is advantageous to implement a time delay between the two pressure transducers 72 and 74 and the density indicating controller 76. This time delay will allow for a more accurate reading of the fluidized bed 26 density because the density indicating controller 76 will make adjustments in flow rate of teeter water entering or exiting the separation tank 14 based upon a density reading of a fluidized bed 26 that has had time to settle between different adjustments. A calculation of an average reading, provided over a small period of time, may also accomplish a more accurate reading of the fluidized bed 26 density.

It can be advantageous to program the density indicating controller 76 to control the minimum and maximum volume of fluidization flow entering and exiting the separation tank 14. For example, the lowest parameter of the volume of fluidization flow should be set to one that is approximately 10-20% less than the minimum actual volume of fluidization flow ideal for the specific type of slurry being used, this effect will limit the potential for sanding problems. The highest parameter of the volume of fluidization flow should be set to one that is approximately 10-20% more than the maximum actual of the volume of fluidization flow ideal for the specific type of slurry being used within the separation tank 14, this effect will limit the misplacement of the particles that are more coarse/dense from accidentally entering into one of the launders 22 or 24.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. A separation system for partitioning a plurality of particles contained in a slurry, the particles influenced by a fluidization flow, which comprises teeter water and gas bubbles, and a fluidized bed, said separation system comprising:

a separation tank, a slurry feed distributor, a fluidization flow manifold, a gas introduction system, and an underflow conduit all arranged to create the fluidized bed in said separation tank by introducing the slurry through said slurry feed distributor and allowing the slurry to interact with the fluidization flow from said fluidization flow manifold;

said separation tank having a launder for capturing particles carried to the top of said separation tank;

and said gas introduction system is configured to optimize the gas bubble size distribution in the fluidization flow, said gas introduction system comprising:

a gas introduction conduit;

a bypass conduit for a flow of teeter water to bypass said gas introduction conduit, said gas introduction system can be adjusted to optimize the gas bubble size distribution by modulating the flow of teeter water through said gas introduction conduit;

said gas introduction conduit and said bypass conduit converge to create the fluidization flow; and the volume of fluidization flow is controlled by modulating the flow through said gas introduction system.

2. The separation system of claim 1 wherein said gas introduction conduit comprises a sparging apparatus for aerating the teeter water.

3. The separation system of claim 1 further comprising a pressure reading apparatus arranged and configured to measure the density of the fluidized bed.

4. The separation system of claim 1 further comprising:

a pressure reading apparatus arranged and configured to measure the density of the fluidized bed; and said pressure reading apparatus comprises two pressure sensors to measure the density of the fluidized bed.

5. The separation system of claim 1 further comprising a differential pressure transmitter configured to measure the density of the fluidized bed.

6. The separation system of claim 1 further comprising a pressure reading apparatus arranged and configured to measure the discrete density of the fluidized bed.

7. The separation system of claim 1 further comprising a density indicating controller for controlling said gas introduction system and said underflow conduit, to adjust the density and level of the fluidized bed based on calculations relayed to said density indicating controller from said pressure reading apparatus.

8. The separation system of claim 1 wherein said slurry feed distributor comprises a slurry aeration system for aerating the slurry.

9. The separation system of claim 1 wherein:

said slurry feed distributor comprises a slurry aeration system for aerating the slurry; and said slurry aeration system comprises a sparging apparatus.

10. The separation system of claim 1 wherein said launder is positioned externally on said separation tank.

11. The separation system of claim 1 further comprising:

said launder is positioned externally on said separation tank; and an internal launder positioned in said separation tank for capturing particles carried to the top of said separation tank.

12. The separation system of claim 1 further comprising a chemical collector introduced into said fluidization flow.

13. The separation system of claim 1 further comprising a surfactant introduced into said fluidization flow.

14. The separation system of claim 1 further comprising:

a teeter water supply line connected upstream from said gas introduction system; and a chemical collector introduced into said teeter water supply line to condition the particles.

15. The separation system of claim 1 further comprising:

a teeter water supply line connected upstream from said gas introduction system; and a surfactant introduced into said teeter water supply line to facilitate aeration of the fluidization flow.

16. A gas introduction system configured to optimize the gas bubble size distribution in a fluidization flow to a fluidization flow manifold in a separation tank of a separator comprising:

an automatic valve to control the volume of fluidization flow by modulating the flow through said gas introduction system;

a pressure reading apparatus located within said separation tank;

a gas introduction conduit;

a bypass conduit for a flow of teeter water to bypass said gas introduction conduit;

said bypass conduit comprising an automatic valve configured to optimize the gas bubble size distribution by modulating the flow of teeter water through said gas introduction conduit;

said gas introduction conduit and said bypass conduit converge to create the fluidization flow; and the gas bubble size dispersion and volume of fluidization flow are modulated by said automatic valves based on the measurements of said pressure reading apparatus to achieve desired operating parameters within said separation tank.

17. The separation system of claim 16 wherein said gas introduction conduit and said bypass conduit are arranged in parallel.

18. The separation system of claim 16 wherein said gas introduction conduit comprises a sparging apparatus for aerating the teeter water.

19. A separation system for partitioning a plurality of particles contained in a slurry, the particles influenced by a fluidization flow, which comprises teeter water and gas bubbles, and a fluidization bed, said separation system comprising:

a separation tank, a slurry feed distributor, a fluidization flow manifold, a gas introduction system, and an underflow conduit all arranged to create the fluidized bed in said separation tank by introducing the slurry through said slurry feed distributor and allowing the slurry to interact with the fluidization flow from said fluidization flow manifold; and a teeter water supply line connected upstream from said gas introduction system; and a reagent introduced into said teeter water supply line to condition the particles.

20. The gas introduction system of claim 19 wherein said reagent is a surfactant to facilitate aeration of the fluidization flow.

21. The gas introduction system of claim 19 wherein said reagent is a chemical collector to condition the particles and render the particles hydrophobic.

22. The gas introduction system of claim 19 wherein said reagent comprises a plurality of chemicals.

* * * * *